US006435192B1

(12) United States Patent
Cancellera

(10) Patent No.: US 6,435,192 B1
(45) **Date of Patent: *Aug. 20, 2002**

(54) SAFETY ASHTRAY

(76) Inventor: Enzo Cancellera, 260 Matheson St., Maple, Ontario (CA), L6A 1B4

( * ) Notice: Subject to any disclaimer, the term of this patent is extended or adjusted under 35 U.S.C. 154(b) by 41 days.

This patent is subject to a terminal disclaimer.

(21) Appl. No.: 09/612,566

(22) Filed: Jul. 7, 2000

(51) Int. Cl.[7] ..... A24F 17/00; A24F 15/00

(52) U.S. Cl. ..... 131/242; D27/102; D27/133; 131/241; 131/257

(58) Field of Search ..... 131/231, 240.1, 131/241, 242, 242.5, 242.6; D27/102, 103, 133, 134, 135

(56) References Cited

U.S. PATENT DOCUMENTS 582,977 A * 5/1897 Bond
1,999,090 A * 4/1935 Dube
2,019,227 A * 10/1935 Jasper
2,235,568 A * 3/1941 Soens
D155,083 S * 9/1949 Frank
2,638,905 A * 5/1953 Morrison
2,703,091 A * 3/1955 Kaufman et al.
2,919,701 A * 1/1960 Aghnides
3,683,938 A * 8/1972 Rowland
D258,316 S * 2/1981 Duin
4,427,016 A * 1/1984 Orter
4,579,129 A * 4/1986 Gillies
4,726,513 A * 2/1988 Wolfe
4,920,988 A * 5/1990 Cancellara ..... 131/242
4,953,571 A * 9/1990 Tremblay
5,085,230 A * 2/1992 Roman
5,287,862 A * 2/1994 Pruyne
5,535,762 A * 7/1996 Li
D430,701 S * 9/2000 Cancellera

* cited by examiner

*Primary Examiner*—Jose Portuna

(57) ABSTRACT

A safety ashtray has a frustoconical configuration formed by a sloping cover over a hollow ash and butt receiving interior region. The cover has a central access opening to the interior region and is provided with a plurality of cigarette rest areas spaced from one another around the cover. Each rest area includes an upper and a lower cigarette catch with each of the catches extending upwardly from the cover, the sloping of which locates the upper catch more centrally of the ashtray than the lower catch. When a cigarette is positioned on the catches, it is prevented from rolling and it is also elevated from the cover by the catches which hold the cigarette in an upwardly inwardly angled position on the ashtray.

7 Claims, 3 Drawing Sheets

SAFETY ASHTRAY

FIELD OF THE INVENTION

The present invention relates to a safety ashtray.

BACKGROUND OF THE INVENTION

A standard ashtray is formed by a wall around a large center opening to receive cigarette ashes and butts. People using the ashtray tend to place their cigarettes on the rim or wall of the ashtray with the burning end in and the butt hanging outwardly of the ashtray. As the cigarette burns down it becomes butt end heavy at which point the cigarette will then fall out of the ashtray. This is a major cause of fires because people will often forget their cigarette leaving it burning in the above position in the ashtray.

I have already patented a safety ashtray covered by U.S. Pat. No. 4,920,988 issued May 1, 1990. In that patent I describe a safety ashtray on which cigarettes are placed in an upwardly inwardly angled position. As the cigarettes burn, they remain on the side wall of the ashtray rather than falling to the outside of the ashtray.

From a safety standpoint, my earlier patented ashtray is extremely beneficial. For example, if a person were to leave a cigarette unattended on the safety ashtray, there is essentially no likelihood of the cigarette falling from the ashtray and creating a fire hazard.

SUMMARY OF THE PRESENT INVENTION

The present invention, like the subject matter of my earlier patent, relates to a safety ashtray including improvements to the ashtray.

More particularly, the safety ashtray of the present invention has a sloping cover over a hollow ash and butt receiving interior region. The cover has at least one access to the interior region and further includes a plurality of cigarette rest areas spaced from one another on the cover.

In accordance with the present invention, each rest area includes an upper and a lower cigarette catch with both of the catches extending upwardly from the cover, the sloping of which locates the upper catch more centrally of the ashtray than the lower catch.

The purpose of the catches is to receive a cigarette in a manner to prevent the cigarette from rolling on the ashtray while at the same time elevating the cigarette away from the cover which improves the burning qualities and taste of the cigarette.

According to an aspect of the present invention, the cover further includes a plurality of finned regions which separate the cigarette rest areas from one another. These finned regions act as ash traps and butt out locations for the cigarettes.

BRIEF DESCRIPTION OF THE DRAWINGS

The above as well as other advantages and features of the present invention will be described in greater detail according to the preferred embodiments of the present invention in which.

DETAILED DESCRIPTION ACCORDING TO THE PREFERRED EMBODIMENTS OF THE PRESENT INVENTION IN WHICH

Figure 1:
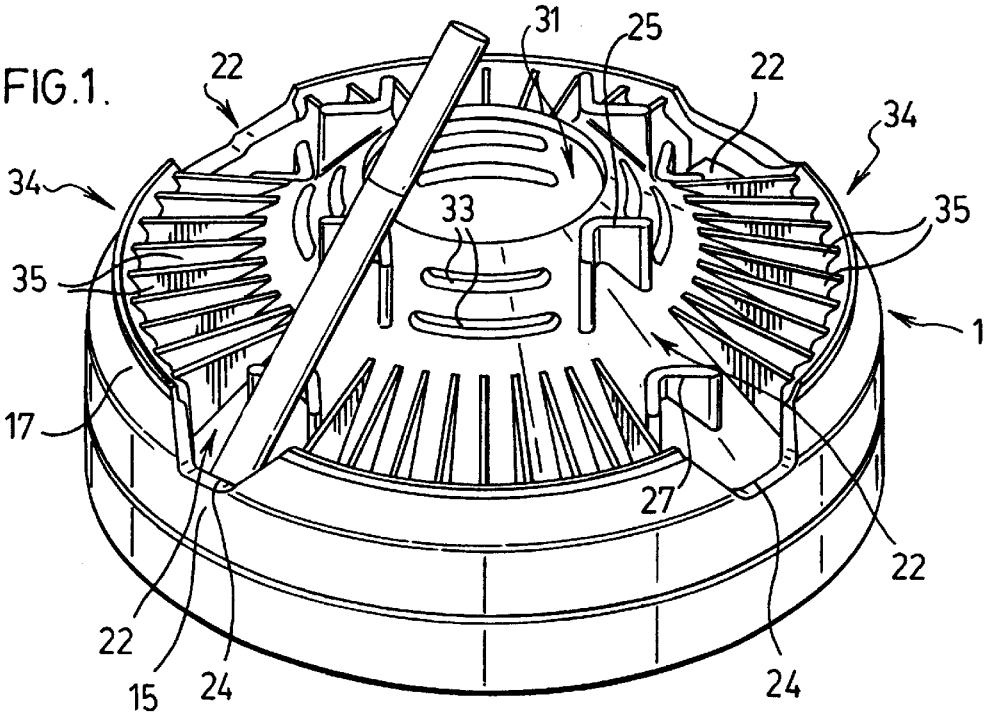
FIG. 1 is a perspective view looking down on the safety ashtray in accordance with a preferred embodiment of the present invention.

FIG. 1 shows a safety ashtray generally indicated at 1. As better seen in FIG. 2 of the drawings, the safety ashtray comprises a top cover piece 3 and a lower base piece 5. The base piece includes upright posts 8 having undercut slots 9. The cover piece, as seen in FIG. 3 includes tabs 7 which, when the two pieces are twisted relative to one another, lock in a bayonet fashion within the slots 9 on pillars 8 of the base piece.

The base piece includes a bottom wall 13 which forms the bottom for the overall ashtray and this bottom wall is surrounded by an upright wall 11 on the base piece.

The cover piece 3 has a sidewall 15 which, when the two pieces are locked together, vertically aligns with the wall 11 on the base piece. This gives the overall ashtray a frusto-conical look, truncated by a large center opening with the appearance that the ashtray has a one piece construction which is appealing from an aesthetic standpoint.

The sidewall 15 on the cover piece has, over part of its length, elevated regions 17 which are separated by truncated triangular recesses 24, the purpose of which will be described later in greater detail.

Figure 2:
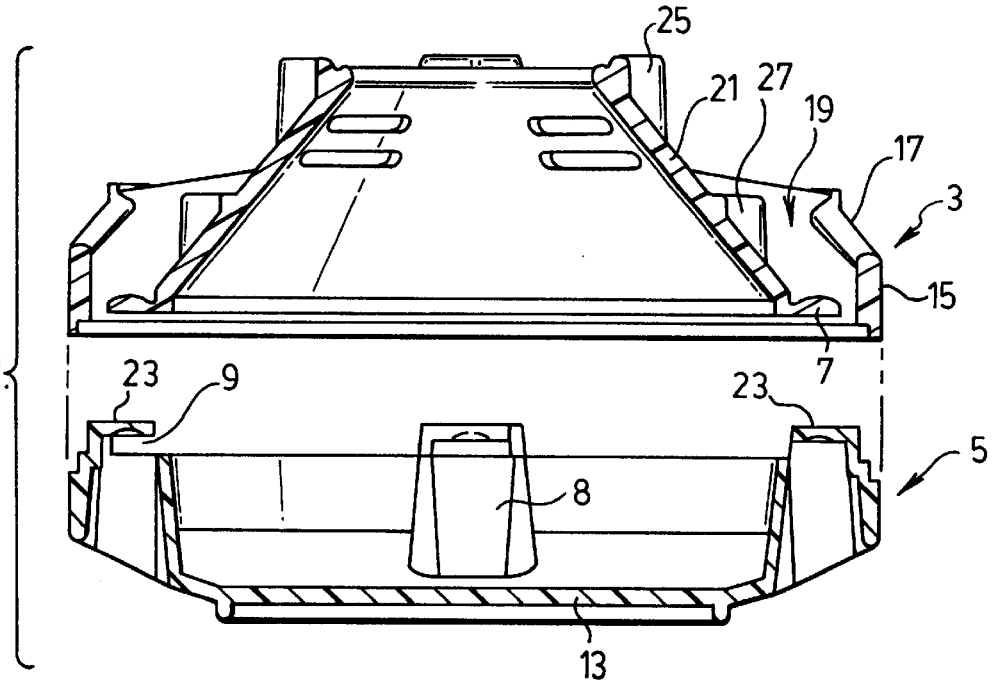
FIG. 2 is an exploded sectional view of the safety ashtray of FIG. 1.
Figure 3:
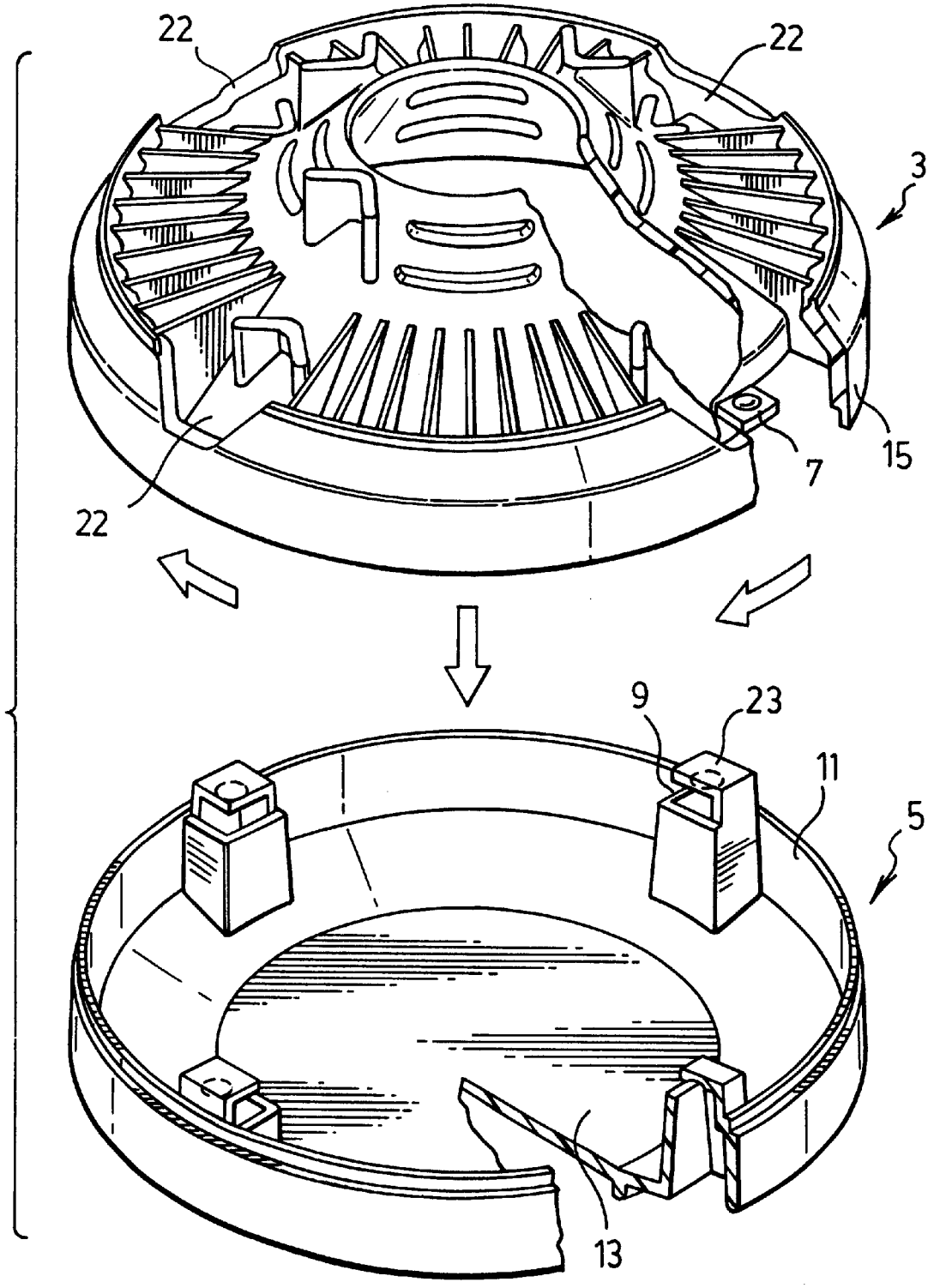
FIG. 3 is a partially sectioned exploded perspective view of the safety ashtray of FIG. 1.

Located internally of the outer wall 15 on the cover piece is a sloping wall 21 well seen in FIG. 2 of the drawings. This sloping wall is separated from the outer wall 15 by an open region 19 between the two walls. The tabs 7 that interlock with the bayonet post 8 locate in this open region. When the two pieces interlock with one another, as shown in FIG. 1, the top surfaces 23 of the bayonet posts align with the recesses 24 in the wall 15 of the top piece for reasons to again be described later in detail.

The cover piece is provided with a plurality of cigarette rest areas generally indicated at 22 spaced from one another over the surface of the cover piece. These cigarette rest areas align with the wall recesses 24 and are defined by an upper cigarette catch 25 and a lower cigarette catch 27. As will be seen in FIG. 1, the sloping of the wall 21 of the cover piece places the upper catch more centrally of the ashtray.

Each of the cigarette catches comprises a pair of ribs forming an outwardly facing V-shaped member rising upwardly from sloped wall 21.

For a standard sized ashtray, i.e. an ashtray having about a six inch diameter, it is preferable to include four equally spaced cigarette rest areas on the ashtray. This allows four individuals to simultaneously use the ashtray without their cigarettes interfering with one another and allowing each individual to easily grasp his or her cigarette from the ashtray.

The cigarette rest areas are separated from one another by a plurality of finned regions generally indicated at 34. Each of these finned regions is formed by a plurality of spaced apart thin finned members 35 bordered to the outside by the taller wall portion 17 of the outer wall 15 on the cover piece. As can clearly be seen in the drawings, wall 17 extends slightly above and defines a protruding lip at the outer edges of fins 35.

The cover piece includes a large center opening 31 which allows access to the interior of the ashtray formed by the base and cover pieces locked together with one another. The hollow interior of the ashtray provides a butt and ash receiving region as well shown for example in FIG. 4 of the drawings. Vents 33 as well as the large center opening allow smoke from the ashes and butts to flow centrally out of the ashtray.

When the ashtray is assembled, as shown in FIG. 1, the butts and ashes are completely hidden interiorly of the ashtray giving it a neat clean appearance. The contents of the ashtray can then easily be cleaned by releasing the two pieces from one another and dumping the debris from the base piece of the ashtray. The two pieces are then easily reassembled for further use of the ashtray.

Figure 4:
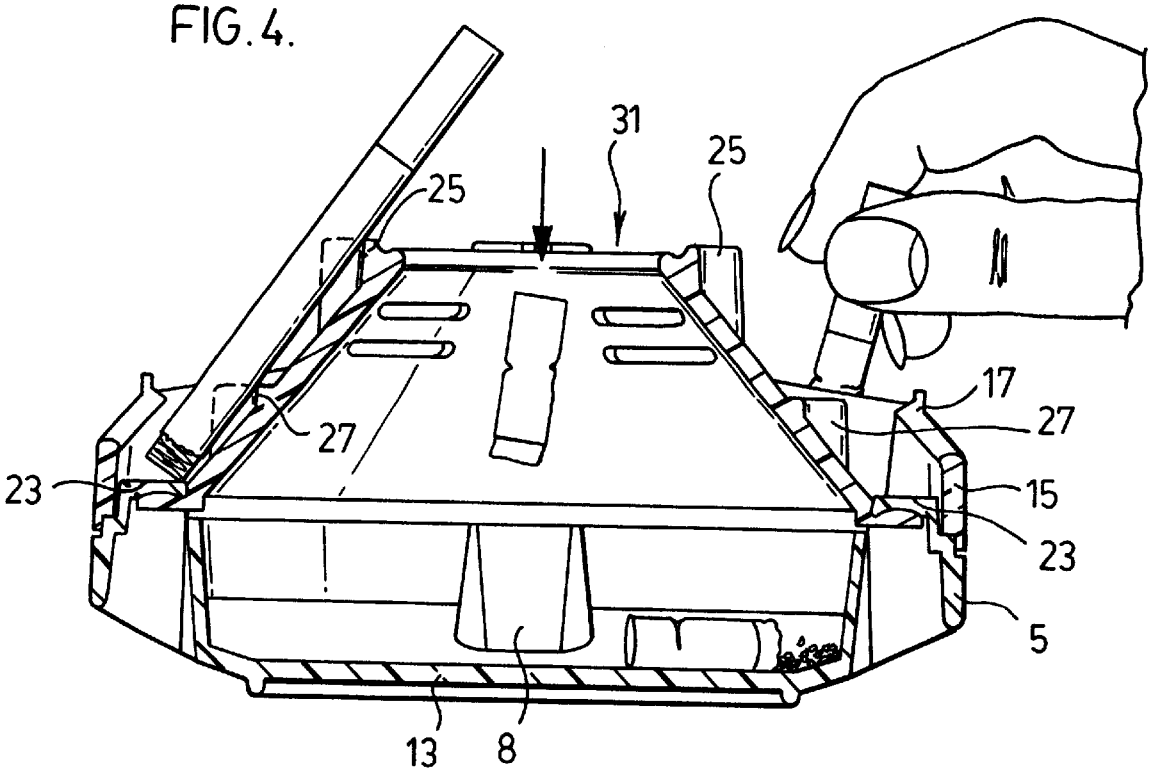
FIG. 4 is an assembled sectional view of the safety of FIG. 1 showing the ashtray when in use.

FIG. 4 shows the ashtray when in use. Here it will be seen that a cigarette, when not being smoked, is placed in any one of the different rest areas where the cigarette engages with the two catches 25 and 27. These catches elevate the main body of the cigarette such that it is up off of sloped wall 21 leaving a clearance space between the cigarette and the ashtray. This clearance space enables an unimpeded burning of the cigarette should it be left on the ashtray as shown for example in FIG. 5. This unimpeded burning of the cigarette causes it to burn evenly and does not affect the taste of the cigarette as would be the case for example if the cigarette were to lie directly against the sloped wall. When the cigarette does burn directly in contact with another surface, the cigarette is blackened by such contact causing it to burn unevenly and detrimentally affecting the taste of the remainder of the cigarette. Accordingly, the cigarette catches not only provide an anti-rolling safety feature, but additionally provide a feature which prevents poor burning and bad taste of the cigarette.

Figure 5:
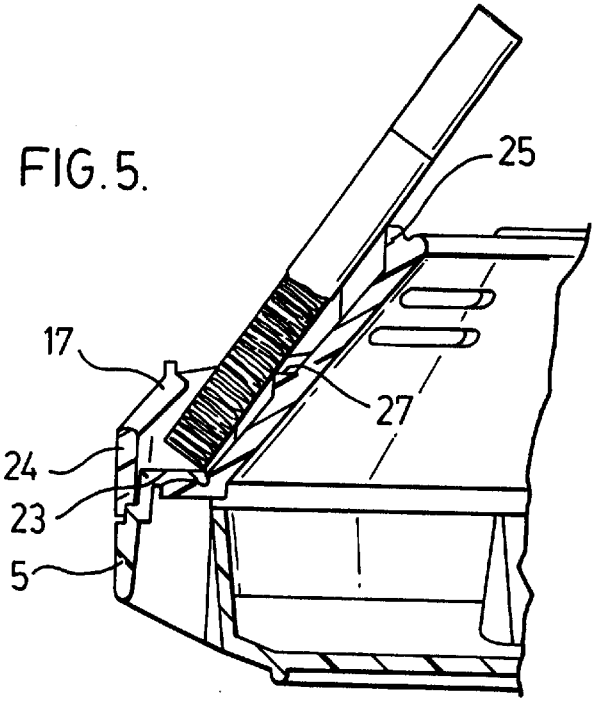
FIG. 5 is a further sectional view of one side of the safety ashtray of FIG. 1 showing a cigarette in a burning position on the ashtray.

The purpose for recessing the outer wall 15 at recess areas 24, aligned with the cigarette rest areas is to allow the smoke from the burning tip of the cigarette to easily flow from the ashtray. The trapping of the smoke in this areas could once again affect both the burning and the taste of the cigarette. Accordingly, only a small lip is provided at each of the cigarette rest areas sufficient to prevent the tip of the cigarette from sliding out of the ashtray. FIGS. 4 and 5 of the drawings, show that support for the tip of the cigarette is provided by the top wall 23 of each of the bayonet posts 8 in the base piece of the ashtray. The top piece of the ashtray is otherwise open through region 19 to the interior of the ashtray.

The finned regions 34 between the cigarette rest areas provide extremely effective places to dump the ashes and to butt out the cigarettes as shown in FIG. 4 of the drawings. The outer reaches of these finned areas bordered by the raised wall parts 17 open, as described above, directly into the interior area of the ashtray so that the spent ashes guided by fins 35 and wall parts 17 fall down onto the base piece as shown in FIG. 4 of the drawings.

It will now be understood how a cigarette placed on the ashtray, even if forgotten remains safely locked against rolling off the ashtray without affecting burning qualities or taste of the cigarette. Furthermore, the ashtray, even when used for butting and dispensing of used cigarettes remains clean and neat in appearance.

Although various preferred embodiments of the present invention have been described in detail, it will be appreciated by those skilled in the art that variations may be made without departing from the spirit of the invention or the scope of the appended claims.

What is claimed is:

1. An ashtray comprising a top piece forming a sloping cover over a base piece defining a hollow ash and butt receiving interior region, the top piece and the base piece being releaseably secured to one another for opening the ashtray and cleaning of the interior region of the base piece, the cover having a least one access opening therethrough to the interior region and being provided with a plurality of cigarette rest areas spaced from one another on said cover, each rest area including an upper and a lower cigarette catch, each catch extending upwardly from the cover the sloping of which locates the upper catch more centrally of the ashtray than the lower catch, a peripheral lip bordering said cover, the peripheral lip being reduced in height at each cigarette resting area.

2. An ashtray as claimed in claim 1, including a plurality of finned regions on said cover, the finned regions separating the cigarette rest areas from one another.

3. An ashtray as claimed in claim 2, wherein said cover has a conical shape truncated by said access opening centrally of said cover.

4. An ashtray comprising a top piece forming a sloping cover over a base piece defining a hollow ash and butt receiving interior region, the top piece and the base piece being releaseably secured to one another for cleaning of the interior region of the base piece, the cover having a central opening therethrough to the hollow interior region and being provided with a plurality of cigarette rest areas spaced from one another around the cover, each rest area including an upper and a lower cigarette catch, the sloping of the cover locating the upper catch more centrally of the ashtray than the lower catch and both catches in each rest area extending upwardly from the cover such that any cigarette placed thereon is elevated from and does not burn against the cover, a cigarette stop surface place below each lower catch of each cigarette rest area, the top piece and the base piece being interlocked with one another at locking posts of said base piece, said locking posts aligning with the cigarette rest areas and forming cigarette a stop surface in each rest area.

5. An ashtray as claimed in claim 4, wherein said ashtray is circular with four of said rest areas around said cover, said rest areas being equally spaced sufficiently far from one another to prevent cigarettes on said catches from interfering with one another.

6. An ashtray as claimed in claim 4, including open regions through the cover piece to the interior of the ashtray between the posts in the base piece.

7. An ashtray comprising a top piece forming a sloping cover over a base piece defining a hollow ash and butt receiving interior region, the top piece and the base piece being releaseably secured to one another for opening the ashtray and for cleaning of the interior region of the base piece, the cover having a central opening therethrough to the hollow interior region and being provided with a plurality of cigarette rest areas spaced from one another on the cover, each rest area including an upper and a lower cigarette catch, the sloping of the cover locating the upper catch more centrally of the ashtray than the lower catch and both catches in each rest area extending upwardly from the cover such that any cigarette placed thereon is elevated from and does not burn against the cover, each catch comprising a pair of small ribs set in a V-shaped pattern with a mouth which opens downwardly away from the central opening in the cover.

* * * * *